United States Patent [19]

Bourque

[11] 4,107,856

[45] Aug. 22, 1978

[54] FAST CLOSING ATHLETIC BOOT

[75] Inventor: Rene Bourque, Laval, Canada

[73] Assignee: The Garcia Corporation, Teaneck, N.J.

[21] Appl. No.: 816,809

[22] Filed: Jul. 18, 1977

Related U.S. Application Data

[63] Continuation of Ser. No. 735,520, Oct. 26, 1976, abandoned.

[30] Foreign Application Priority Data

Sep. 13, 1976 [CA] Canada ..... 261092

[51] Int. Cl.[2] ..... A43B 5/04; A43B 11/00; A63C 3/02

[52] U.S. Cl. ..... 36/115; 36/50; 280/11.36

[58] Field of Search ..... 36/115, 118, 120, 121, 36/109, 50; 280/11.1 R, 11.12, 11.36, 11.3

[56] References Cited

U.S. PATENT DOCUMENTS

| | | | |
|---|---|---|---|
| 1,139,530 | 5/1915 | Johnson | 36/115 |
| 2,660,812 | 12/1953 | Henke | 36/117 |
| 3,235,978 | 2/1966 | Hyde | 36/115 |
| 3,408,752 | 11/1968 | Lollmann | 36/117 |

*Primary Examiner*—Patrick D. Lawson
*Attorney, Agent, or Firm*—Fitzpatrick, Cella, Harper & Scinto

[57] ABSTRACT

A molded athletic boot such as an ice skate boot or ski boot is formed of a lower portion to which is hinged an upper. The lower includes an upstanding extension on each side of the forward instep portion to which flexible straps are secured. The extensions are crossed and the straps pass through apertures in the upper to encircle the back of the boot. The straps may then be drawn tightly around the back of the boot and secured together to close the boot around the foot of the wearer.

14 Claims, 8 Drawing Figures

FAST CLOSING ATHLETIC BOOT

This is a continuation of application Ser. No. 735,520 filed Oct. 26, 1976, now abandoned.

BACKGROUND OF THE INVENTION

The present invention relates generally to molded athletic boots such as ski boots and ice skates and is more specifically directed to a novel shell construction which permits fast closing of a molded athletic boot about the wearer's foot.

It is now well-known to manufacture athletic boots such as ski boots and ice skates from molded synthetic materials. The use of leather or other materials for ski boots has now completely disappeared and as regards ice skates and particularly hockey skates, synthetic molded shells are becoming increasingly popular due to the durability and protection afforded by the synthetic material.

One of the problems experienced with molded athletic boots is the provision of adequate closure means for closing and tightening the boot about the wearer's foot. In ski boots there is normally provided a plurality of lever-type buckles spaced along the closure flaps of the boot shell. Although such buckles are acceptable for ski boot use, they are not adaptable to ice skate shells and particularly hockey skates, primarily for safety reasons. For example, the lever of a lever-type buckle would present a dangerous implement capable of injuring another skater. Accordingly, ice skates and hockey skates having a synthetic outer shell have heretofore been constructed with eyelets and laces such as previously used in skates manufactured of leather.

One of the major drawbacks of ice skates having a molded outer shell and a lace-type closure system is that the synthetic shell is considerably more rigid than leather and requires a corresponding increase in lacing tension to tightly draw the boot closed. Skating enthusiasts and particularly amateur and professional hockey players require the skate to fit very tightly about the foot. Accordingly, with the previously used lacing system it was difficult to achieve this tightness without time-consuming and strenuous pulling forces applied to the laces. This also often leads to breakage of the laces which is an obvious undesirable aspect.

Accordingly, the principal object of the present invention is the provision of a molded athletic boot and particularly a hockey skate which can be quickly and tightly fitted about the wearer's foot.

SUMMARY OF THE INVENTION

The present invention overcomes the disadvantages of the prior art and, provides a novel boot construction which is quickly and easily closed about the wearer's foot. In accordance with the present invention, the novel molded athletic boot comprises a lower or vamp portion and an upper or leg portion; means securing said upper and lower for limited relative rotation; said lower including a pair of integral upstanding extensions at approximately the instep area to which are secured flexible straps; said upper having apertures formed therein through which, after crossing to form an X, the straps pass to encircle the back of the boot; said lower further including an upstanding tendon guard having guide means through which at least one of said straps passes; and means for securing said straps together.

The present invention thus provides a boot shell which may be opened from the top for insertion of the foot and quickly closed by grasping the free ends of the straps and drawing same in a generally rearward direction. The novel construction of the shell is, in such manner, readily and tightly closed around the important areas of the wearer's foot, such as the instep, leg and back.

In its technical sense, the boot of the present invention may be classified as a rear entry type boot since the upper is continuous across the forward leg area.

There has thus been outlined, rather broadly, the more important features of the invention in order that the detailed description that follows may be better understood and in order that the present contribution to the art may be better appreciated. There are, of course, additional features of the invention that will be described hereinafter and which will form the subject of the claims appended hereto. Those skilled in the art will appreciate that this invention may be utilized as the basis of designing other structures for carrying out the several purposes of this invention. It is therefore, important that the claims be regarded as including such equivalent constructions as do not depart from the spirit and scope of the invention.

BRIEF DESCRIPTION OF THE DRAWINGS

One embodiment of the invention has been chosen for purposes of illustration and description, and is shown in the accompanying drawings forming a part of the specification, wherein:

FIG. 7 is a cross-sectional view of the tendon guard taken along lines 7—7 of FIG. 6.

DETAILED DESCRIPTION OF THE INVENTION

Figure 1:
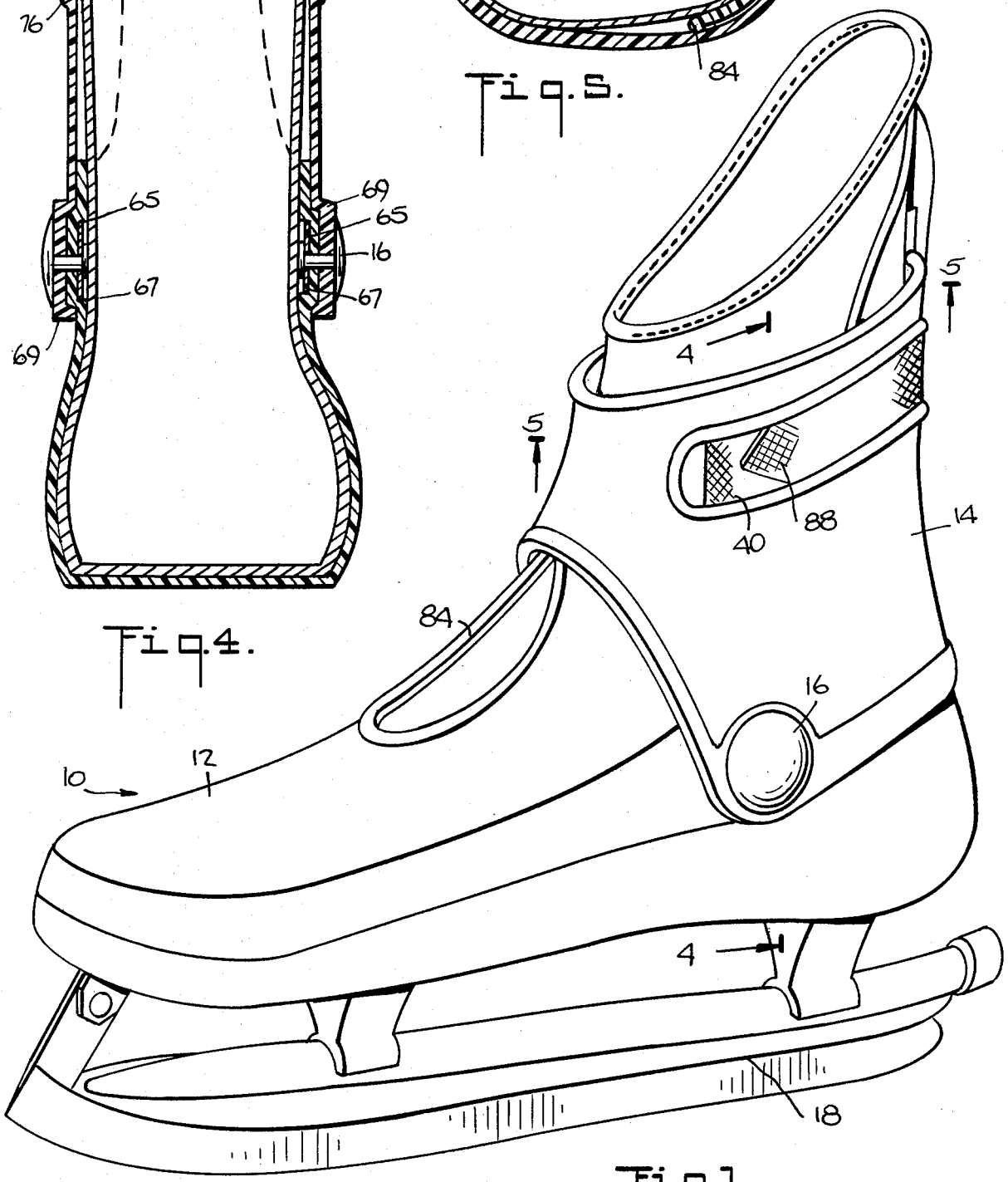
FIG. 1 is a perspective view of a hockey skate boot shell constructed in accordance with the present invention.
Figure 2:
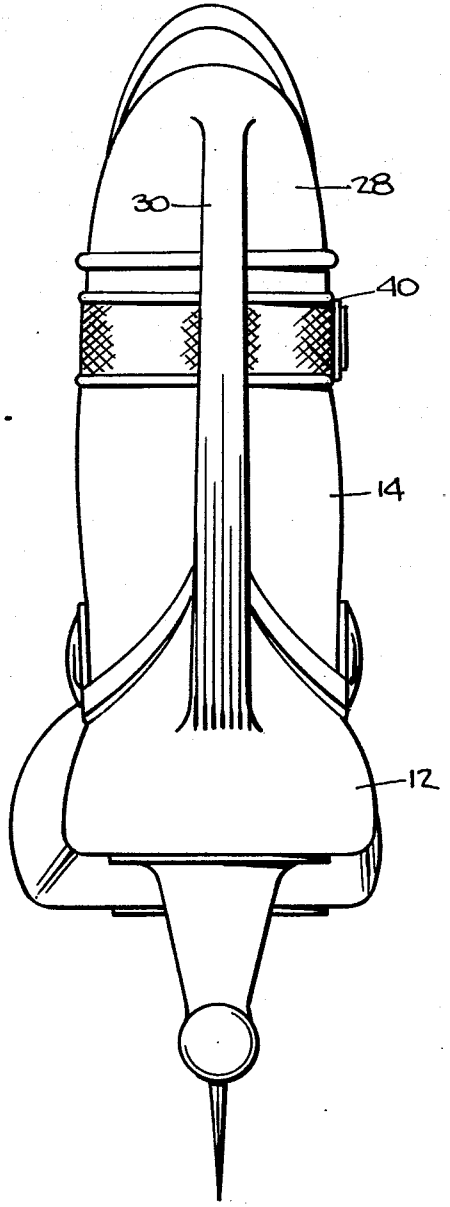
FIG. 2 is a rear perspective view of the hockey skate illustrated in FIG. 1.

With reference to FIG. 1, the fast closing molded athletic boot of the present invention is generally indicated by the numeral 10 and comprises a molded lower or vamp portion 12 and a molded upper or leg portion 14. The two portions are connected by rivets 16 slightly below the ankle area whereby the upper 14 may rotate longitudinally to a limited extent relative to the lower 12.

The boot of the present invention is particularly suited as a hockey skate shell and is shown in such application in FIG. 1. As such, a blade and runner assembly generally indicated by the numeral 18 is mounted by suitable mounting means (not shown) to the underside of the lower 12. The blade and runner assembly, as well as the mounting means are of known construction.

To complete the skate, an inner boot or liner, generally indicated by the numeral 20, which is also of known construction, is placed within the shell formed by the upper 14 and lower 12. The liner 20 provides padding between the semi-rigid synthetic shell and the wearer's foot.

Although illustrated in some figures as an ice skate shell, those skilled in the art will appreciate that the novel shell construction may easily be adapted to a ski boot shell by molding a thickened sole to the bottom of the lower and by modifying the tendon guard, hereinafter described, as a spoiler.

The upper 14 and lower 12 are preferably molded in separate operations and thereafter assembled. Any of the processes and materials normally used for molding shells of athletic boots are acceptable for manufacturing the shell of the present invention. The shell elements of the invention may thus be prepared using the known injection molding processes as well as casting of materials such as polyurethene and other moldable polymers. In a casting process, the lower 12 would be formed about a last in a mold, heat treated and thereafter removed for assembling and the upper 14 would be formed in like manner. If the upper and lower element are formed by injection molding, those thermoplastics which lend themselves to injection molding may be used.

Figure 6:
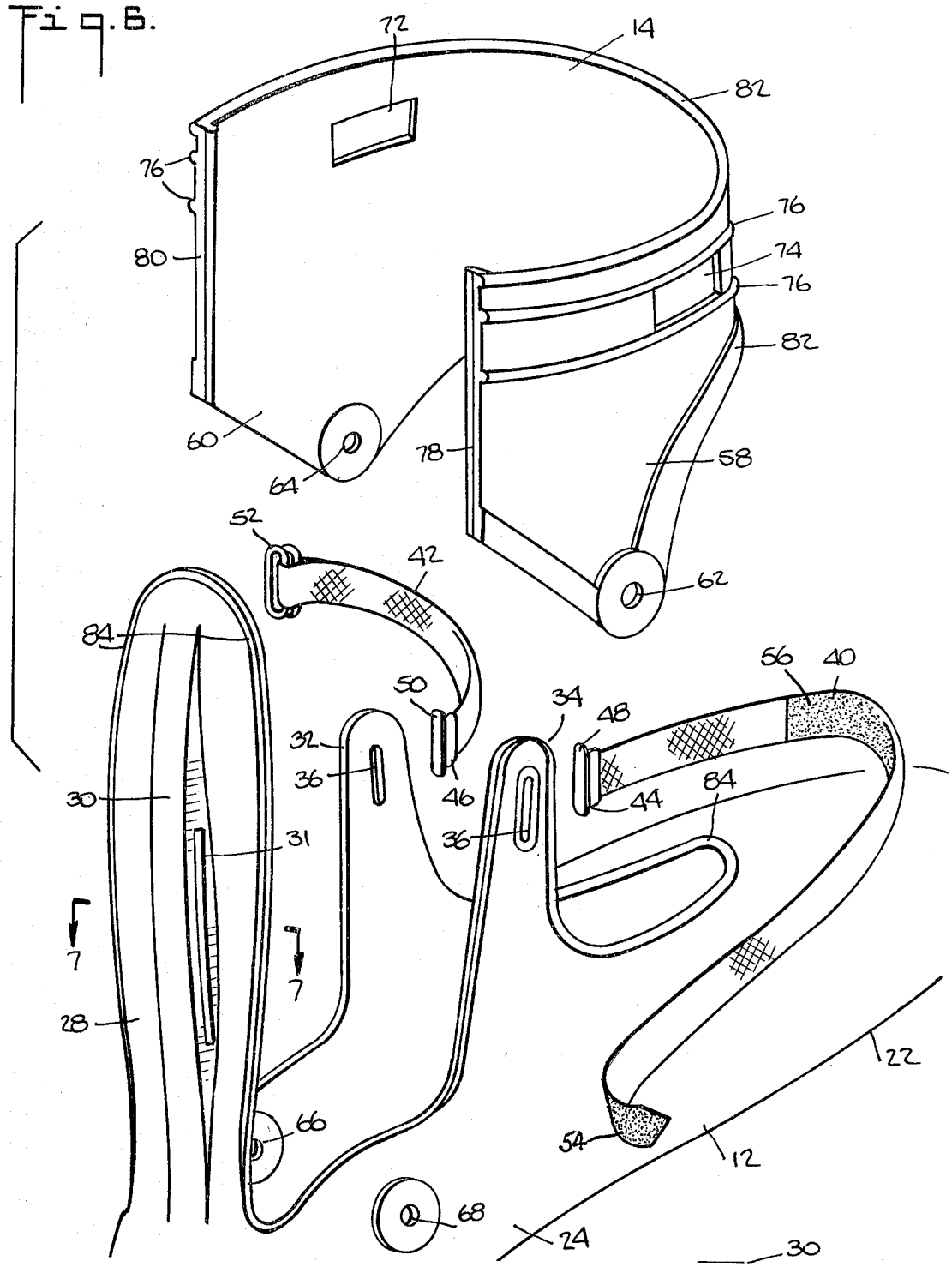
FIG. 6 is an exploded view of a molded shell constructed in accordance with the present invention.

As shown most clearly in FIG. 6, lower 12 has the general configuration of a slipper thus defining a foot receiving member having a toe area 22, arch area 24 and heel area 26. Extending vertically from the heel area 26 is a tendon guard 28 having a reinforcing rib 30. The rib 30 includes a slot 31 through a portion thereof, the function of which will be described more fully hereinafter.

Lower 12 further includes a pair of lateral upstanding extensions 32, 34 positioned approximately adjacent the instep area. For simplicity of molding operations it is preferred to form the extensions integrally with lower 12. However, the extensions could be formed separately and attached to the side walls of lower 12 by any suitable means if desired. Secured to the distal end of each extension is a flexible strap 40 and 42. Straps 40 and 42 may be constructed of any flexible material but are preferably heavy duty nylon which has been found to be sufficiently strong and wear resistant. However, any flexible material, including plastic, may be used. To secure the straps to the extensions, slots 36 are formed in the ends thereof through which the straps 40, 42 are passed. Stops 44 and 46 are secured to the ends of straps 40, 42 and include heads 48 and 50 respectively, dimensioned slightly larger than slot 36, thus to firmly hold the ends of straps 40, 42 to the particular extension. When assembled, strap 40 passes through slot 36 in extension 34 so that the head 48 lies on the inside of the extension; and strap 42 passes through slot 36 of extension 32 with its head 50 on the inside of the extension.

A double loop buckle 52 is secured to the end of strap 42 in known fashion such as by doubling over the strap and stitching same back upon itself. Strap 40 on the other hand is preferably manufactured with a pull-apart fastener 54 located proximate the distal end. A coacting pull-apart type fastener 56 is located more towards the middle of the strap which coacts with fastener 54 when strap 40 is doubled back upon itself. Preferably, fasteners 56, 54 are of a hook and loop type closure means such as that sold under the trademark VELCRO. Strips of the two elements of the VELCRO fastener may be readily secured to strap 40 at the desired locations such as by stitching or adhesive.

Upper 14 is of general U-shaped configuration having downwardly disposed extensions 58 and 60 having apertures 62 and 64 therein. When assembled, apertures 62 and 64 align with apertures 66 and 68 in lower 12 located slightly below the ankle region and rivets 16 (FIGS. 4 and 8) are passed therethrough to secure the two members together. For this purpose, annular recesses 65 are formed on the inside of lower 12 around apertures 66 and 68 into which washers 67 of similar configuration are positioned to provide a firm seat for rivets 16. Additionally, it is preferred to form upper 14 with annular thickened areas 69 around apertures 62, 64 for additional support. Upper 12 is thus assembled so that the open edges of the "U" are at the back and the closed end forms a continuous area around the front of the leg area.

Generally rectangular apertures 72 and 74 are formed in upper 14 on each side thereof down from the top edge. Top and bottom beadings 76 extend rearwardly from each aperture 72, 74 to the rear edges 78 and 80 of upper 14. Beadings 76 are spaced vertically to form a channel therebetween of the same width as apertures 72 and 74 which, in turn, are dimensioned slightly wider than the width of straps 40 and 42. It is also presently preferred to slightly bevel the thickness of upper 14 within the channel defined by beading 76 to gradually taper down to the trailing edge of apertures 72 and 74. However, beveling is not necessary and the thickness of the upper 14 may remain relatively constant throughout.

Finally, when molding, it is preferred to form a beading 82 along the edges of upper 14. Similarly, a beading 84 is formed on the edges of lower 12, extensions 32, 34 and tendon guard 28. This reduces friction to a minimum during movement of upper 14 relative to lower 12. Moreover, the beading 82 and 84 prevents the occurrence of sharp edges which could chafe the liner 20.

Figure 8:
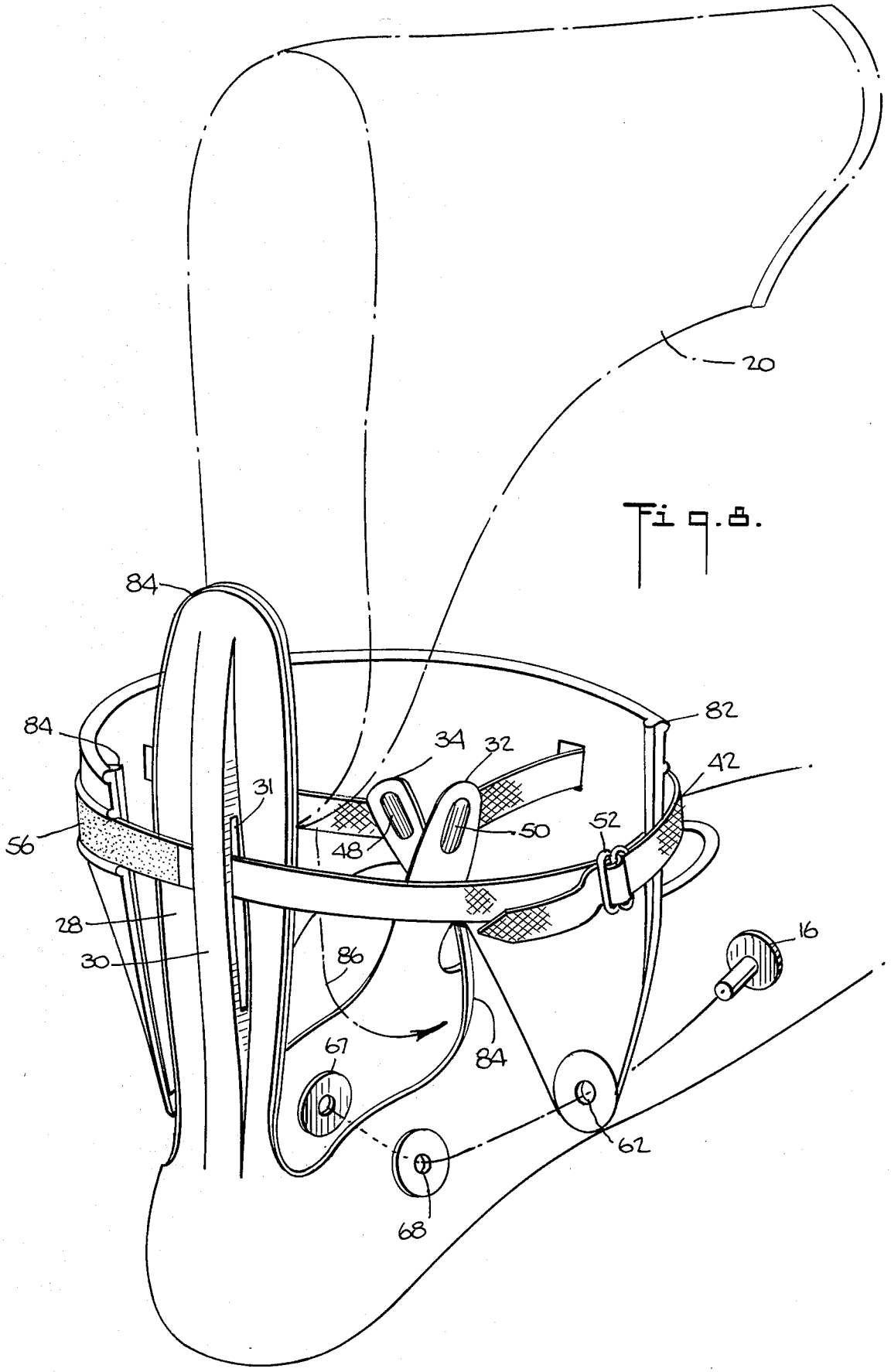
FIG. 8 is another exploded view of the molded boot shell of the invention, illustrating the manner of insertion of an inner liner.

With reference to FIG. 8, the arrangement of extensions 32, 34 and straps 40, 42 when upper 14 and lower 12 are assembled is most clearly shown. When assembled, extensions 32, 34 and associated straps 40 and 42 are crossed one over the other to form an X and the straps are passed through the apertures 72 and 74 on the opposite sides of the upper, respectively. Thus, strap 40 associated with the right hand extension 34 is passed through aperture 72 located on the left hand side of upper 12. Conversely, strap 42 which is associated with the left hand extension 32 passes through the aperture 74 located on the right hand side of upper 12. The longer of the straps, in this case strap 40, is then passed through guide 31 formed in rib 30 of the tendon guard 28 and looped through the double loop buckle 52 on strap 42. At this point, the boot is in an opened position. To complete the boot, inner boot or liner 20 is then positioned within the foot receiving portion of the lower 12 as shown by arrow 86 in FIG. 8. The inner boot 20 is normally maintained within the shell formed by upper 14 and lower 12. After the inner boot and shell assembly have been positioned on the wearer's foot, it is necessary only to grasp the free end 88 of strap 40 and pull same in a rearward direction to close the boot. It will be appreciated that the single pulling force applied to the end 88 of strap 40 simultaneously draws the sides of lower 12 up and over the instep area of the wearer's foot and constricts the diameter of upper 14 to firmly close the shell of the boot around the wearer's foot.

Figure 3:
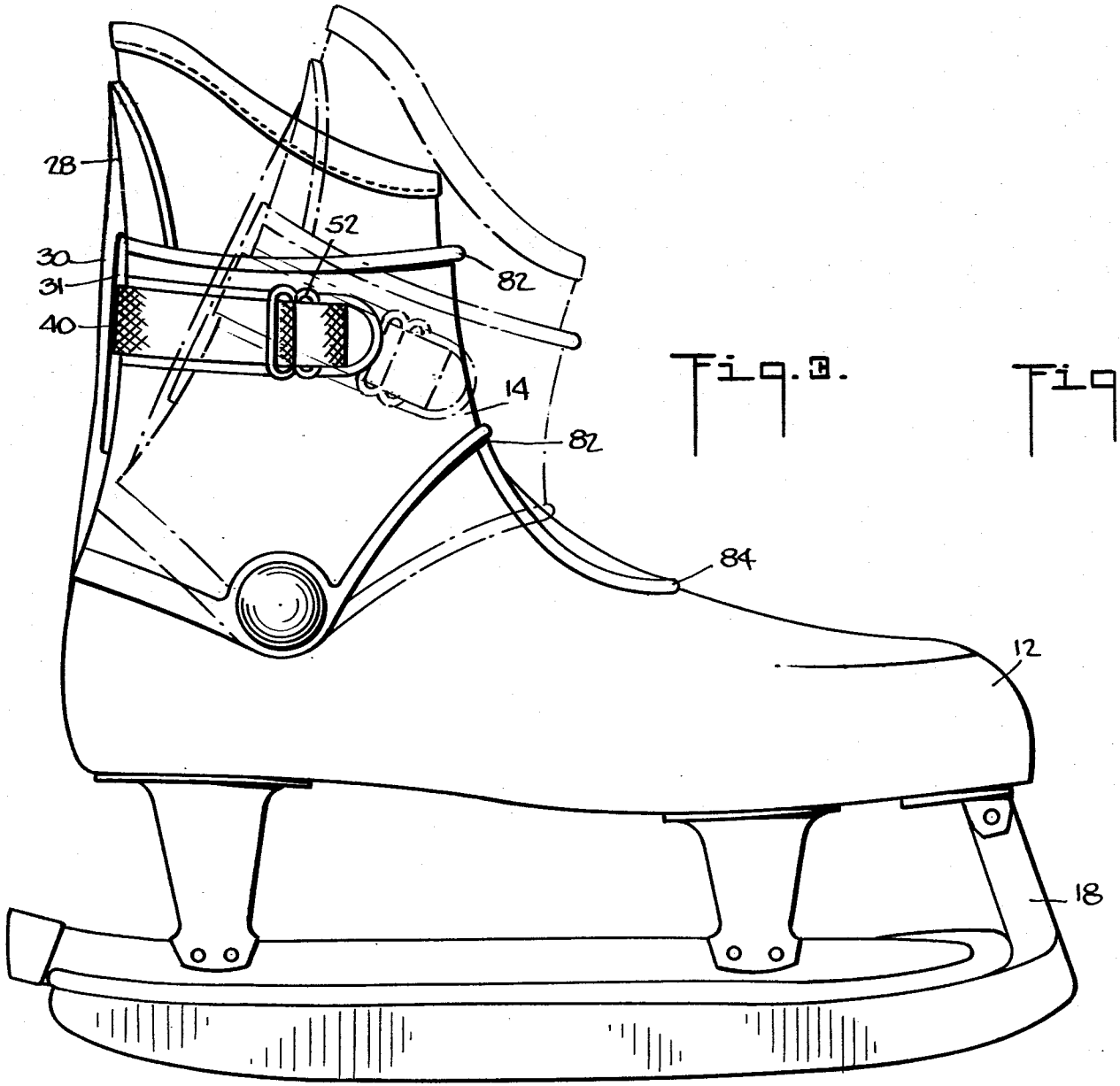
FIG. 3 is a view similar to FIG. 1 illustrating, in phantom, pivoting of the upper.

As shown, strap 40 passes through slot or guide 31 in rib 30 of the tendon guard 28. This arrangement serves to maintain strap 40 in a proper attitude around the back of the boot. It will be noted that guide 31 is of sufficient length to allow considerable vertical play of strap 40 therein. For this purpose the length of guide 31 is approximately 8 cm. The width of the guide is, of course, dependent on the thickness of the strap 40. The width should be slightly more than twice the thickness of the strap so that the latter member may freely slide therein when doubled back on itself. When the boot is closed and upper 14 is in a relative vertical position, strap 40 occupies a position approximately in the center of guide 31. With reference to FIG. 3, it will be seen that when upper 14 pivots forwardly strap 40 is permitted to slide upwardly to the top extremity of the slot 31. This is necessary since the tendon guard 30 is in a fixed position relative to upper 14. In a reverse motion, the opposite movement of the strap is permitted.

Figure 4:
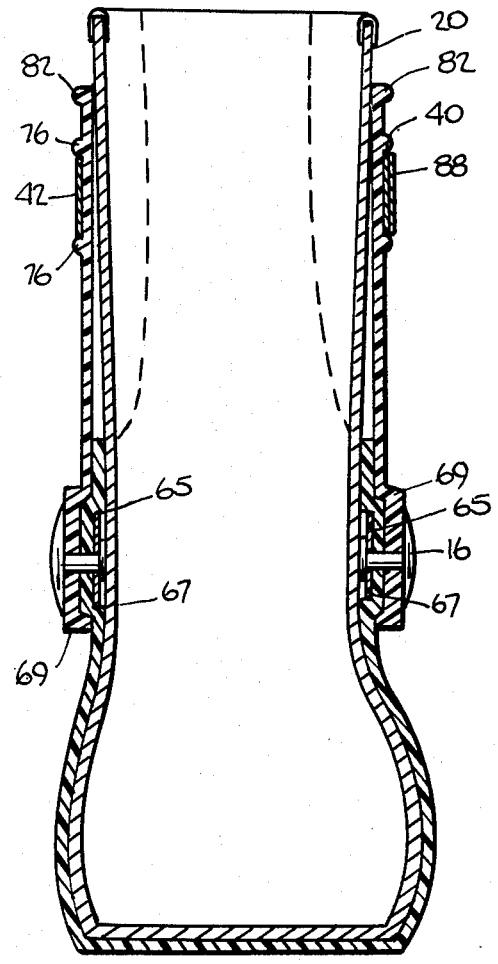
FIG. 4 is a cross-sectional view taken along lines 4—4 of FIG. 1.

To secure end 88 of strap 40, after drawing the boot closed, there is provided, as above described, a pull-apart type fastener. Thus when strap 40 is doubled back on itself it may be secured by the simple application of pressure. This connects the coacting elements 54 and 56 of the VELCRO fastener which are on strap 40. It will be appreciated that element 56 of the pull-apart type fastener should be considerably larger than the coacting element 54 located at end 88 of strap 40 to compensate for various size legs. Since strap 40 is considerably longer than strap 42, element 56 should be positioned so that when the boot is closed such element will be at the side of upper 14 where end 88 is fastened thereto after passing same back through guide 31 as shown in FIGS. 1 and 4. In addition to anchoring end 88 during use of the boot, the pull-apart type fastener also prevents strap 40 from creeping through buckle 52 under the tension placed thereon during use of the boot.

Although the length of straps 40 and 42 will vary according to various boot sizes, it is presently preferred for strap 40 to be approximately 20 cm. and strap 42 to be approximately 8 cm.

It will also be noted that as shown in the figures, particularly FIG. 8, the elements are illustrated in connection with the boot for the right foot thus having buckle 52 located on the outside of the foot whereby the end 88 of strap 40 may be readily grasped. Conversely, on the left boot the straps would be arranged oppositely to that illustrated in FIG. 8. Moreover, it should be understood that although the present invention is illustrated with one strap having a double loop buckle and the other strap carrying both coacting elements of a pull-apart type fastening such as that manufactured under the trademark VELCRO, the straps may be connected one to the other by any suitable means such as a plurality of snaps. Buckle 52 may also be dispensed with while providing one strap with an outer layer of a loop type fabric and the other strap with an inner layer of hooks, thus forming a pull-apart type fastener of the VELCRO type. However, it is presently preferred to use the structure illustrated in the figures as this provides for a secure connection between the straps which will not become loose during use of the boot.

Figure 5:
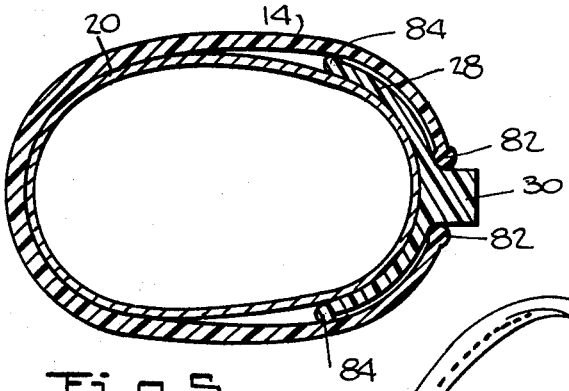
FIG. 5 is a cross-sectional view taken along lines 5—5 of FIG. 1.

The dimensions of the lower 12 and upper 14 will, of course, vary according to the particular foot size of the boot manufactured. A shell manufactured in accordance with the present invention will, however, for a given foot size, accommodate a wide variety of leg widths. Although the maximum diameter of upper 14 is governed solely by rivets 16 which inhibit the opening thereof, it is preferred that the rear edges 76 and 78 of upper 14 should not, when the boot is closed, be opened to an extent whereby the tendon guard 28 is fully exposed. In fact, for preferential performance, edges 76 and 78 of upper 14 should be closely adjacent to rib 30 when the boot is closed as the rib not only provides rigidity for the tendon guard 28 but also provides lateral stability for upper 14 when edges 76 and 78 abut against same, maintaining relative alignment of such edges. The minimum diameter of upper 14 is governed by edges 76 and 78 abutting rib 30 of the tendon guard 28 as shown in FIG. 5. Even if the wearer's leg is smaller than the minimum diameter, any extra space will be in front of the upper leaving a gap between the shells. This gap will not affect function, support, or fit since the front of the lower and back of the upper provides the support for the leg and foot.

What is claimed is:

1. A molded athletic boot comprising:

a lower shaped to substantially encase the toe, sides and heel of the wearer's foot, said lower including an upward extension on each side thereof, and an upward extension from the heel area;

a generally U-shaped upper;

means connecting said upper and lower for limited relative rotation, said upper being arranged with its open sides adjacent said heel extension and the closed portion of said U-shaped upper disposed opposite to said heel extension;

a flexible strap connected to the end of each of said upward side extensions of said lower, said upper provided with an aperture on each side thereof dimensioned to receive one of said straps; and connecting means associated with said straps, each of said straps being constructed and arranged to pass from its associated extension through the aperture on the opposite side of said upper and around the back of said heel extension of said lower whereby said upward extensions are disposed in overlapping relationship at the instep area of the wearer's foot when said lower and upper are closed about said wearer's foot and secured thereon by drawing said straps and fastening same together.

2. A molded athletic boot according to claim 1 wherein said heel extension is a tendon guard and said boot is an ice skate shell.

3. A molded athletic boot according to claim 1 which further includes a liner positioned therein.

4. A molded athletic boot according to claim 1 wherein said means rotatably connecting said upper and lower comprises rivets extending therethrough slightly below the ankle region.

5. A molded athletic boot according to claim 1 wherein said strap connecting means comprises a double-loop buckle secured to the end of said straps.

6. A molded athletic boot according to claim 5 wherein said connecting means further includes a pull-apart type fastener means associated with the other of said straps, said fastener means being arranged whereby said strap may be doubled back and fastened to itself.

7. A molded athletic boot according to claim 6 wherein said pull-apart fastener means is a strip of hooks and a strip of loops, said strips being positioned to mate when said strap is doubled back on itself.

8. A molded athletic boot according to claim 1 wherein said heel extension further includes guide means for said straps, said guide means adapted to permit limited vertical movement of said straps when said straps are connected and said upper and lower are in a closed position.

9. A molded athletic boot according to claim 8 wherein said guide means comprises a vertical rib on the rear surface of said heel extension, said rib provided with a slot dimensioned to receive at least one of said straps and permit limited vertical movement thereof, said rib providing reinforcement for said heel extension and alignment for the sides of said upper disposed thereagainst to ensure lateral stability of said upper.

10. A molded athletic boot according to claim 1 wherein said side extensions each include a slot at the distal end thereof dimensioned to receive a strap and each of said straps includes a stop at an end thereof dimensioned larger than said slot to connect said straps to the respective extension.

11. A molded ice skate shell which comprises:

a lower shaped to substantially encase the toe, sides and heel of the wearer, said lower including an upward extension on each side thereof and a tendon guard extending upwardly from the heel area thereof, said tendon guard including stabilizing means formed thereon.

a runner and blade assembly secured to the bottom of said lower;

a generally U-shaped upper pivotally connected to said lower for limited relative rotation about a transverse axis slightly below the ankle region of said shell, said upper, when said shell is secured about a wearer's foot, being arranged with its open sides overlapping the edges of said tendon guard adjacent said stabilizing means and the closed portion of said U-shaped upper disposed opposite said tendon guard and adjacent said upward extensions;

a flexible strap connected to the end of each of said extensions of said lower, said upper provided with an aperture on each side thereof dimensioned to receive one of said straps; and connecting means associated with said straps, each of said straps being constructed and arranged to pass from its associated extension through the aperture on the opposite side of said upper and connect across the open end of said U-shaped upper and around the outer surface of said tendon guard whereby said upward extensions are disposed in overlapping relationship at the instep area of the wearer's foot when said lower and upper are closed about said wearer's foot and secured thereon by drawing said straps and fastening same together.

12. A molded ice skate shell according to claim 11 further including a liner positioned therein.

13. A molded ice skate shell according to claim 11 wherein said stabilizing means is a vertical rib on said tendon guard, said rib having a slot dimensioned to receive at least one of said straps and permit limited vertical movement therein while also providing reinforcement for said guard.

14. A molded ice skate shell according to claim 11 wherein said upper and lower are pivotally connected by means of a rivet extending therethrough on each side of said shell.

* * * * *